US008117765B2

(12) United States Patent
Aaltonen et al.

(10) Patent No.: US 8,117,765 B2
(45) Date of Patent: Feb. 21, 2012

(54) APPARATUS AND METHOD OF SEALING OF A POCKET SPACE BETWEEN DRYING CYLINDERS IN A PAPER MACHINE OR A BOARD MACHINE

(75) Inventors: Rami Aaltonen, Turku (FI); Pekka Saarikivi, Raisio (FI)

(73) Assignee: Metso Paper, Inc., Helsinki (FI)

( * ) Notice: Subject to any disclaimer, the term of this patent is extended or adjusted under 35 U.S.C. 154(b) by 1063 days.

(21) Appl. No.: 11/921,728

(22) PCT Filed: Jun. 6, 2006

(86) PCT No.: PCT/FI2006/000179

§ 371 (c)(1),
(2), (4) Date: Jan. 25, 2008

(87) PCT Pub. No.: WO2006/131589

PCT Pub. Date: Dec. 14, 2006

(65) Prior Publication Data

US 2009/0007451 A1 Jan. 8, 2009

(30) Foreign Application Priority Data

Jun. 6, 2005 (FI) ..... 20050596

(51) Int. Cl.
*F26B 25/00* (2006.01)

(52) U.S. Cl. ..... 34/444; 34/497; 34/114; 34/117; 162/272; 162/278

(58) Field of Classification Search ..... 34/110, 34/114, 117, 444, 456, 497, 446; 162/272, 162/278

See application file for complete search history.

(56) References Cited

U.S. PATENT DOCUMENTS 4,516,330 A * 5/1985 Eskelinen et al. ..... 34/456

(Continued)

FOREIGN PATENT DOCUMENTS

EP 0 726 220 8/1996

(Continued)

OTHER PUBLICATIONS

Finnish Search Report dated May 11, 2006 issued in a corresponding foreign application.

*Primary Examiner* — Stephen M. Gravini
(74) *Attorney, Agent, or Firm* — Cozen O'Connor

(57) ABSTRACT

The invention relates to an arrangement and a method for sealing of a pocket space between drying cylinders (2, 3) in a paper machine or similar. In the method for sealing of the pocket space: a wire (5) is moved supported by the first and the second cylinder (2, 3, 4), a gap between the pocket space (15) and the space outside (24) it is sealed by a runnability component (6), which comprises at least a sealing surface (19, 22) and a blow nozzle (21) provided with a nozzle slot (26) of a size of 0.5-3.5 mm and elongated in the cross direction, the sealing surface (19, 22) is kept at a distance of 5-15 mm from the moving wire (5), air is blown with the blow nozzle (21) from a blow point (27) and along the sealing surface (22) towards a sealing point (16) and further via the sealing point (16) away (24) from the pocket space. The invention comprises also a runnability component (6) and a method for manufacturing the same. The parts of the runnability component are fastened together at least mainly without welding in the cross direction of the paper machine.

11 Claims, 4 Drawing Sheets

U.S. PATENT DOCUMENTS

| | | | | |
|---|---|---|---|---|
| 4,539,762 | A * | 9/1985 | Eskelinen et al. | 34/114 |
| 4,628,618 | A | 12/1986 | Virta et al. | |
| 4,693,784 | A * | 9/1987 | Aula et al. | 162/202 |
| 4,905,380 | A | 3/1990 | Eskelinen et al. | |
| 4,932,138 | A * | 6/1990 | Liedes et al. | 34/456 |
| 5,074,278 | A | 12/1991 | Turcotte | |
| 5,570,519 | A | 11/1996 | Solin et al. | |
| 5,711,088 | A | 1/1998 | Lindqvist et al. | |
| 5,783,044 | A * | 7/1998 | Schneider et al. | 162/278 |
| 5,873,180 | A | 2/1999 | Grunder | |
| 5,891,309 | A | 4/1999 | Page et al. | |
| 6,189,232 | B1 * | 2/2001 | Milosavljevic et al. | 34/117 |
| 6,247,247 | B1 | 6/2001 | Yömaa et al. | |
| 6,317,999 | B1 | 11/2001 | Virta et al. | |
| 6,848,195 | B2 | 2/2005 | Leimu | |
| 6,921,460 | B2 * | 7/2005 | Hermans et al. | 162/301 |
| 2003/0034138 | A1 | 2/2003 | Kahl et al. | |
| 2009/0007451 | A1 * | 1/2009 | Aaltonen et al. | 34/242 |

FOREIGN PATENT DOCUMENTS

| | | |
|---|---|---|
| FI | 971729 | 10/1998 |
| FI | 102400 | 11/1998 |
| FI | 102774 B | 2/1999 |
| FI | 4349 U 01 | 2/2000 |
| FI | 111280 B | 6/2003 |
| JP | 10-110397 | 4/1998 |
| JP | 11-124785 | 5/1999 |
| JP | 2002-146692 | 5/2002 |
| JP | 2003-064591 | 3/2003 |
| WO | WO 2004/046460 | 6/2004 |

* cited by examiner

APPARATUS AND METHOD OF SEALING OF A POCKET SPACE BETWEEN DRYING CYLINDERS IN A PAPER MACHINE OR A BOARD MACHINE

CROSS REFERENCE TO RELATED APPLICATIONS

This is a U.S. national stage of application No. PCT/FI2006/000179, filed on 6 Jun. 2006. Priority is claimed on the following application(s): Country: Finland, Application No.: 20050596, Filed: 6 Jun. 2005; the content of which is/are incorporated here by reference.

BACKGROUND OF THE INVENTION

1. Field of the Invention

The invention relates to an arrangement and method for sealing of a pocket space between drying cylinders in a paper machine or similar as presented in the preamble of the independent claim presented below. The invention particularly relates to a new manner of arranging air blows in the pocket space. The invention also relates to a runnability component of a paper machine and to a method for manufacturing the same.

2. Description of the Prior Art

In a typical dryer section of a paper or board machine the web to be dried is conveyed, supported by one or two wires, via hot drying cylinders. The tendency of the web to detach from the surface of the drying wire thus causing runnability problems has presented a problem. Especially problematic in this connection are the following points

- so-called opening nips, i.e. locations where the web and the wire detach from the drying cylinder. In this case, the web has traveled between the wire and the cylinder, and as the wire detaches from the cylinder, the web tends to follow the surface of the cylinder and then detach from the wire; and
- so-called closing nips, where the web and the wire are brought into connection with the cylinder. In this case, the web tends to detach from the wire due to an overpressure formed in the nip.

Opening and closing nips exist both at the drying cylinders and between them, and usually in connection with the lower turning cylinders or turning rolls.

Detachment of the web from the wire easily leads to a web break or at least to formation of pouches or cockles in the web. Detachment of the web from the wire thus leads to runnability problems, which problems are further emphasized when the speeds of the paper machines increase.

It is previously known to use different kinds of runnability components, such as blow boxes, for improving the runnability of a paper machine. A component improving runnability has been presented in the American patent publication U.S. Pat. No. 4,905,380, which presents a blow suction box to be used in a multi-cylinder dryer of a paper machine. With an ejection blow created with the blow box, an underpressure zone is induced in the gap space between the drying wire and the wall of the blow box, which underpressure zone keeps the web attached to the drying wire as the web travels from the drying cylinder to the turning roll below it. The underpressure zone is obtained in the gap space on the exit side of the drying cylinder with an ejection blow against the travelling direction of the wire. Respectively, an underpressure zone is created or it is intensified on the exit side of the turning roll below the drying cylinder, in the gap space defined by the drying wire and the wall of the blow suction box, with an ejection blow in the travelling direction of the drying wire.

The solution described above however presents the problem of arriving to safely seal the underpressure zone induced with blows from the area remaining outside the zone. In connection with malfunction, paper waste is created in paper machines, which paper waste often forms paper clods or wrinkles in the web, which cause problems in narrow points of the machine, e.g. in the narrow spaces between blow boxes and wires, cylinders or rolls. Due to paper clods travelling along with the web to be dried and with the wire, or due to other corresponding bulges appearing in the web, the blow box can not be mounted at a desired short distance from the moving wire. Fairly great safety distances are required between wires and blow boxes for that said bulges could travel along with the wire by the blow box without touching it and without damaging its constructions or the wire. As the blow nozzles of the blow boxes need to be placed at said safety distance from e.g. the wire, the effects of the ejection blows often remain insufficient. The underpressure zone is also not sealed well enough.

This problem has been solved e.g. in the patent publication U.S. Pat. No. 6,247,247 B1. The publication presents a sealing element, such as a blow nozzle, arranged at the border of the desired underpressure zone and the area remaining outside the zone, protruding from the blow box towards the wire and to a given distance "d" from the wire, in order to form a seal between the underpressure zone and the area remaining outside of the underpressure zone. The sealing element is connected to the blow box such that the element can be moved away from the wire by pressing and/or with the aid of an actuator, to a distance "D", which is greater than the distance "d". The solution is working, but however, air leaks by the sealing. This in turn causes undesired energy consumption.

The prior art runnability components, such as blow boxes are not quite straight in their longitudinal direction, i.e. in the cross direction of the machine. The bending of the runnability components is usually a few millimeters. This is one of the reasons for which it has not been possible to bring the sealing elements very close to the wire.

SUMMARY OF THE INVENTION

The main aim of the present invention is to reduce or even eliminate the prior art problems presented above.

The aim of the present invention is to provide an arrangement, with which a desired underpressure is obtained in a pocket space between drying cylinders in a paper machine or similar in an inexpensive and effective manner.

One aim of the invention is to provide a cost-effective runnability component of a paper machine or similar.

One aim of the invention is energy saving.

One aim of the invention is to provide a runnability component whose dimensions, location in the pocket space and running parameters are such that the desired underpressure is provided in the pocket space between the drying cylinders of a paper machine or similar in an inexpensive and effective manner.

One aim of the invention is an arrangement with which approximately one and the same desired underpressure is obtained in each point of one pocket space between the drying cylinders and the turning roll of a paper machine or similar in an inexpensive and effective manner.

One aim of the invention is an arrangement with which the runnability problems caused by so-called opening and/or closing nips can be reduced in the pocket space of a paper machine or similar.

In order to realize i.a. the above aims, the arrangement and method according to the invention are characterized by what is presented in the characterizing parts of the appended independent claims.

The exemplary embodiments presented in this text and their advantages relate by applicable parts to the arrangement, runnability component as well as methods according to the invention, even though this is not always separately mentioned.

In a typical arrangement according to the invention for sealing of a pocket space between drying cylinders, said pocket space is defined at least by:

- a first and a second cylinder;
- a wire, which is arranged to be supported by the first and the second cylinder and to be movable in relation to the cylinders in the running direction of the wire; and
- a first runnability component, which is elongated in the cross direction of a paper machine or similar.

A typical runnability component comprises at least:

- a first sealing surface, which is elongated in the cross direction of a paper machine or similar. At the first sealing point, the first sealing surface is arranged at a sealing distance from the wire. In a typical arrangement according to the invention the sealing distance is chosen between 5-15 mm;
- a first blow nozzle having a nozzle slot of a size equal to the nozzle width and elongated in the cross direction, which nozzle slot is arranged to blow air at the first blow point towards the first sealing point, and which nozzle slot is arranged to blow air along the first sealing surface. In a typical arrangement according to the invention the nozzle width B is chosen between 0.5-3.5 mm.

A typical method according to the invention for sealing of the pocket space between the drying cylinders in a paper machine or similar has at least the following phases:

- the wire is moved in its running direction supported by the first and the second cylinder;
- the gap between the pocket space and the space outside it is sealed with a first runnability component which is elongated in the cross direction of the paper machine or similar and comprises at least a first sealing surface, which is elongated in the cross direction, and a first blow nozzle provided with a nozzle slot of a size equal to the nozzle width and elongated in the cross direction;
- at the first sealing point, the first sealing surface is kept at a sealing distance from the moving wire. This sealing distance is typically between 5-15 mm;
- with the first blow nozzle air is blown from the first blow point and further along the first sealing surface towards the first sealing point and further via the sealing point away from the pocket space. The nozzle width is typically chosen between 0.5-3.5 mm, whereby also the thickness of the air layer discharged from the blow nozzle is between 0.5-3.5 mm when it leaves the nozzle slot.

A paper machine or similar means e.g. a paper machine or a board machine. A pocket space means a space in the dryer section of a paper machine defined by rolls, cylinders or similar and a wire transported supported by them, into which space a lower pressure than the pressure prevailing in the surroundings of the pocket space is desired to be created with the aid of the invention. A typical pocket space is defined by two drying cylinders, a wire turning element placed between the drying cylinders, and a wire travelling via them. The pocket space is defined with the runnability component such that the volume of the area in which an underpressure is created is smaller than the above-mentioned space defined by the rolls, cylinders or similar, and the wire. A typical runnability component is fitted, in the dryer section, in the pocket space defined by a wire, which runs from the first drying cylinder to the second drying cylinder, and a turning device, such as a turning cylinder, turning roll, suction roll or similar fitted on this wire run, in order to eject air away from said pocket space and to obtain an underpressure zone at least in part of this pocket space. A wire means a planar fabric, usually made of plastic or metal, and commonly used in paper machines or similar, supported by which wire the paper web is conveyed in a paper machine or similar. A runnability component is a device with the aid of which the run of the web in a paper machine and especially in its dryer section is stabilized. A blow box is an example of a runnability component. A sealing surface means the part of a runnability component according to the invention, which in a normal running situation is placed closest to the moving wire or web in the sealing point according to the invention. The sealing point defines the pocket space between the cylinders arranged between the first cylinder, the second cylinder and the web. The distance at which the sealing surface and the moving wire or web find each other in a normal running situation at the sealing point, is called sealing distance. The cross direction of a paper machine or similar means a direction transverse to the main travelling direction of the web and the wire. The main travelling direction of the web and the wire is called machine direction. A blow nozzle is an element formed in the runnability component, which element is provided with a nozzle slot, i.e. an opening through which air is blown from the inside of the runnability component towards the sealing point. Nozzle diameter or width is the size of the nozzle slot in that perpendicular direction in respect of the cross direction, which defines the thickness of the air layer to be blown as seen perpendicularly away from the sealing surface. Blow point is the place where the blow opening is situated, i.e. the place where the air layer to be blown moves from the blow nozzle to its outside. The fact that the air layer moves along the sealing surface means that the air layer to be blown according to the invention is directed to travel very close to the sealing surface such that the air layer to be blown comes into contact with the sealing surface.

The most important advantage of the invention is that, thanks to it, a desired underpressure is attained in the pocket space between the drying cylinders of a paper machine or similar at considerably smaller quantities of air than previously known. This means that with the aid of the invention, compared to present runnability components and pocket space arrangements, a considerable amount of energy is saved. The energy savings compared to the present runnability components can be e.g. 35-40%. Energy is saved especially in long, entirely so-called single-wire draw dryer sections. Typically, paper machines with single-wire draw have a bigger number of pocket spaces and thus also more runnability components than paper machines with double-wire draw. The invention is thus well suited for single-wire draw paper machines or similar.

A small amount of air is advantageous, as this allows the required air to be transferred in less space: the devices, such as blow box, blast air entry channels and air discharge channels can be built smaller. Smaller amounts of air also reduce the need for circulating air in the hood. Also the control of the dryer section hood balance, i.e. the ratio of the amount of supply air and exhaust air becomes easier. The arrangement according to the invention can be realized also with relatively small air pressures. Thereby in connection with renovation of runnability equipment, a new runnability component according to the invention can be connected to fairly old and possibly ineffective air systems and blowers already in use at the mill.

With the blow nozzle solution according to the invention, the underpressure effect during the run is intensified in the pocket space. During tail threading a very efficient air removal from the pockets is obtained. The pressure zones of the pockets can be controlled, i.e. the paper web can be kept attached to the wire more advantageously than before.

It has thus now been surprisingly found that by choosing the distance of the sealing surface from the wire and the size of the nozzle slot, i.e. the size of the air layer to be blown, in a certain manner, considerably smaller amounts of air than in the prior art solutions applying ejection blows can be used in order to obtain a desired underpressure in the pocket space. One advantageous combination of sealing distance and nozzle diameter or width is:

- sealing distance 8-10 mm, nozzle diameter or width 1.5-2.5 mm.

Other advantageous combinations of sealing distance and nozzle diameter or width are for example:

- sealing distance 8-10 mm, nozzle diameter or width 2.0-3.0 mm,
- sealing distance 10-15 mm, nozzle diameter or width 2.5-4.0 mm,
- sealing distance 10-15 mm, nozzle diameter or width 3-3.5 mm.

One way of describing an advantageous arrangement according to the invention is that the ratio of the sealing distance and the nozzle diameter is advantageously between the values 3 and 5.

Furthermore, it has been surprisingly found that if, in an arrangement according to the invention, a certain velocity of the air layer to be blown is chosen depending on the size of the nozzle slot to be used, a special effectiveness is achieved. Advantageously, the air layer discharged at the blow point from the blow nozzle towards the first sealing point is blown at a blow velocity of 30 m/s-90 m/s. The velocity of the air layer to be blown can be guided e.g. by guiding the pressure of the air brought into the runnability component. Some advantageous combinations of the thickness of the air layer and the blow velocity are:

- thickness of the air layer 0.5-1.5 mm and blow velocity 70-90 m/s,
- thickness of the air layer 1.5-2.5 mm and blow velocity 50-70 m/s,
- thickness of the air layer 2.5-3.5 mm and blow velocity 30-50 m/s.

In an application of the invention the distance between the blow point and the sealing point counted along the sealing surface is 2-5 times the sealing distance, e.g. 3-4 times the sealing distance.

The invention is based on arranging the nozzle diameter or width, i.e. the thickness of the air layer to be blown discharged from the blow nozzle, such that the air layer and the air ejected therewith from the pocket space can suitably travel through the gap between the sealing surface, such as a Coanda surface, and the wire. If the ratio of the sealing distance and the nozzle diameter or width is too small, the jet does not function effectively, as in this case the narrow way out hinders the flowing. On the other hand, if the said ratio is too big, the air layer to be blown and the ejected air travel at the sealing point out of the pocket space only along the other edge, typically along the sealing surface. In this case at the sealing point, on the other edge, typically by the wire, a return flow, i.e. a leakage flow, is carried along into the pocket space. This naturally impairs the underpressure in the pocket space.

If a big nozzle slot is used, e.g. having a nozzle diameter or width of 3 mm or more, more air will be consumed than when using a nozzle slot of 1 mm with the same velocity of blown air. With a nozzle slot of 3 mm, a nozzle blow velocity of e.g. 40 m/s is sufficient. On the other hand, with a nozzle slot of 1 mm a bigger blow velocity is needed, e.g. 80-100 m/s. The blow velocity is obtained by pressure, i.e. whether a lot of pressure and a little of air can be used, or a lot of air and a little of pressure.

In an application of the invention, two runnability components according to the invention, with a dimensioning according to the invention, are arranged in one pocket space. Thereby the pocket space is typically also provided with a wire turning element, such as a suction roll or a turning roll, which is arranged between the first and the second cylinder in the running direction of the wire. With such an arrangement, a desired underpressure can be effectively obtained in the entire pocket space. Of course, even more runnability components according to the invention can be thought to be mounted in the pocket space. A second runnability component can be mainly of one and the same structure with the first one. The second runnability component means in this connection that sealing points according to the invention exist in two different locations in the same pocket space.

In a typical application of the invention, the nozzle slot and thereby also the blow point is arranged in the pocket space. Thereby the direction of the blow is towards the outside from the inside of the pocket space. This blowing method has been proven to be efficient.

In an application of the invention, the sealing surface is curved in the running direction of the wire, i.e. a so-called Coanda surface. Thereby the ejection effect of the blow is further intensified. The sealing point, i.e. the place where the sealing surface is closest to the moving wire, is thereby in the area of the curved Coanda surface.

In an application of the invention, the sealing surface is fastened to the runnability component by a hinge such that the sealing distance A in the sealing point is changeable. This kind of a sealing surface can be turned to a desired safety distance from the wire, when needed, whether automatically or by using a suitable actuator. Thereby with the solution according to the invention, the immobile blow box structures can be kept at a suitable safety distance from the wire. At the same time, in a normal running situation, the sealing surface can be kept close to the wire in order to obtain an efficient sealing.

In an application according to the invention, the first blow nozzle is arranged to blow air mainly against the travelling direction of the wire. In an application of the invention, the second blow nozzle is arranged to blow air mainly in the travelling direction of the wire. With this kind of an arrangement, e.g. a situation where both blows are directed outwards from the pocket space is obtained. For example, in a pocket space formed by two drying cylinders and a turning element, the first blow nozzle can be arranged at the opening nip of the so-called entry side drying cylinder, and the second blow nozzle can be arranged at the closing nip of the so-called exit side drying cylinder.

A typical runnability component of a paper machine according to the invention comprises

- one or more frame plates, which are elongated in the cross direction of the paper machine
- at least one profile, which is elongated in the cross direction of the paper machine.

A blow nozzle is typically formed in the profile, which blow nozzle is provided with a nozzle slot of a size equal to the nozzle diameter or width B and elongated in the cross direction. The profile is typically fastened to the frame plate without welding in the cross direction of the paper machine.

In a typical method according to the invention for manufacturing a runnability component at least one elongated frame plate is formed, at least one elongated profile is formed, a blow nozzle is formed in the profile, which blow nozzle is provided with a blow slot of a size equal to the nozzle diameter or width B and elongated in the cross direction, the profile is fastened to the at least one frame plate without welding in the cross direction of the paper machine.

The runnability component according to the invention is suitable for use especially in the arrangement and method according to the invention for sealing of the pocket space between the drying cylinders. The runnability component is suitable for use also in other arrangements and methods.

The profile comprising a blow nozzle is typically made of aluminium e.g. by extrusion. The profile can of course be made also of some other suitable material. In an application the profile is formed of one piece dimensioned over the entire cross direction of a paper machine. The profile can also be made of several shorter pieces successively arranged together. The frame plate and other possible parts of the runnability component are made e.g. of aluminium, but other materials can also come into question. Depending on the design of the runnability component, there can be more than one frame plate and one profile, e.g. two of both. The runnability component can also comprise other parts, such as end plates, different kinds of assemblies e.g. for transporting air, and sealing elements. As the runnability components are known art as such, their structure and details are not discussed further here. A typical runnability component according to the invention has a length in the cross direction of a paper machine of over 4 meters, over 6 meters or over 8 meters. The blow nozzle can be formed entirely of one and the same profile. It is also conceivable that the blow nozzle is formed by combining two elongated pieces together, e.g. the profile and the frame plate, such that an elongated gap remains between the pieces thus forming the nozzle slot of the blow nozzle.

Traditional welding introduces a lot of heat in the joints. Therefore, welded structures tend to bend to some extent. Fastening the profile into the frame plate without welding in the cross direction of the paper machine means that the main fastening of the frame plate and the profile to each other is made without welding in the cross direction of the paper machine generating a lot of heat. Traditional welding may comprise e.g. less than 10%, less than 5% or less than 1% of the length of the interface between the frame plate and the profile. Advantageously, traditional welding is not used in the cross direction of the paper machine at all.

With the aid of this application of the invention, the runnability components can be made straighter than before. In this way, the runnability component can be placed close to the wire. Thereby the sealing effect obtained with the runnability component in the pocket space between the cylinders is intensified and the runnability of the paper machine is improved.

In an application of the runnability component according to the invention, it further comprises at least one sealing surface, which is elongated in the cross direction of the paper machine. Thereby the nozzle slot of the blow nozzle is directed such that the air blown from the nozzle slot is directed along the sealing surface when using the runnability component. In an application of the invention, the sealing surface is fastened to the runnability component in a turnable manner. The sealing surface can be a separate part or it can be formed as one and the same part of the frame plates or the profile of the invention. If the sealing surface is a separate part, it is also typically fastened to the rest of the runnability component without welding in the cross direction of the paper machine generating a lot of heat.

It is conceivable that in a runnability component according to the invention the at least one profile to be fastened to the at least one frame plate is a combination formed of several parts, consisting e.g. of a frame, a blow nozzle and a sealing surface and fastening devices, with which these parts are fastened together. Thereby, in the profile, e.g. the frame and the blow nozzle can be formed of one piece and the sealing surface can be movably fastened to them by a hinge and a spring.

In an application of the runnability component and its method of manufacture, the profile and/or the sealing surface are fastened to the frame plate by rivets or by bolts and nuts. The rivets or bolts may exist in the cross direction of the paper machine by intervals of e.g. 10-30 cm. The profile can be fastened to the frame plate also by some other method, which does not generate a lot of heat, such as by laser welding.

BRIEF DESCRIPTION OF THE DRAWINGS

In the following, the invention is described more in detail referring to the enclosed schematic drawing, in which.

DETAILED DESCRIPTION OF THE EMBODIMENTS OF THE FIGURES

Figure 1:
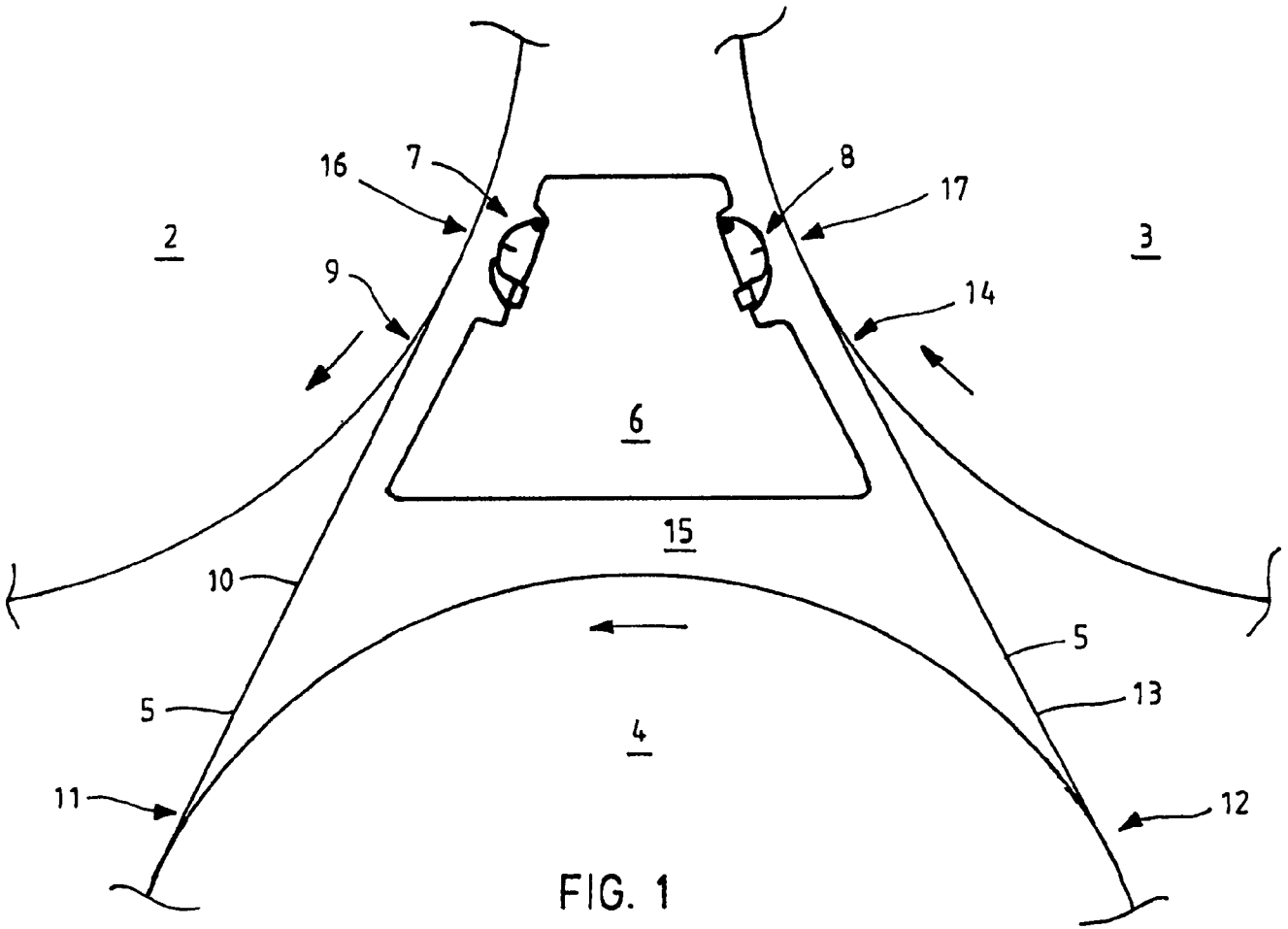
FIG. 1 presents, as a side view, a pocket space according to the invention in a paper machine dryer section.

Same reference numerals are used to refer to parts corresponding each other.

FIG. 1 presents a first drying cylinder 2, a second drying cylinder 3, a turning cylinder 4, and a wire 5 travelling via said cylinders. The turning cylinder 4 can be for example a grooved roll, a suction roll, i.e. a so-called vac-roll, a perforated roll or a smooth roll. A runnability component 6 is fitted in the space between the cylinders, into which runnability component two flexible sealing elements 7 and 8 are arranged. The cylinders 2 and 3 rotate clockwise as shown by arrows in the Figure, and the cylinder 4 rotates anti-clockwise. The wire 5 comes along the surface of the cylinder 2 to the location 9 of the opening nip, where it detaches from the cylinder surface. The wire 5 runs as a so-called free draw 10 to the cylinder 4. At the location 11 of the so-called closing nip the wire comes into contact with the cylinder 4 surface. At the opening nip 12 the wire detaches again from the cylinder 4 and runs as a free draw 13 to the closing nip 14, where the wire comes into contact with the second drying cylinder 3. For the sake of clarity, the paper web to be dried is not shown in the Figure, but it runs supported by the wire 5. At the cylinders 2 and 3 the paper web runs between the wire 5 and the cylinders, and it goes around the cylinder 4 on the outer side of the wire 5. A pocket space 15 to be brought into underpressure is formed around the runnability component 6. In the example of FIG. 1 the pocket space 15 to be brought into underpressure is defined, in addition to the runnability component 6, by the wire 5 from the left and the right side, and by the turning cylinder 4 from below. The upper edges of the pocket space 15 to be brought into underpressure are sealed at sealing points 16 and 17 by the sealing elements 7 and 8. The structure of the sealing point 16 is shown as an enlargement in FIG. 2. The pocket space 15 is sealed also in the cross direction of the paper machine. Walls covering the head of the pocket space 15 are typically arranged on both sides of the paper machine or similar, and at the same time also of the pocket space 15, close to the heads of the cylinders 2, 3 and 4. The walls are not shown in the Figures.

Figure 2:
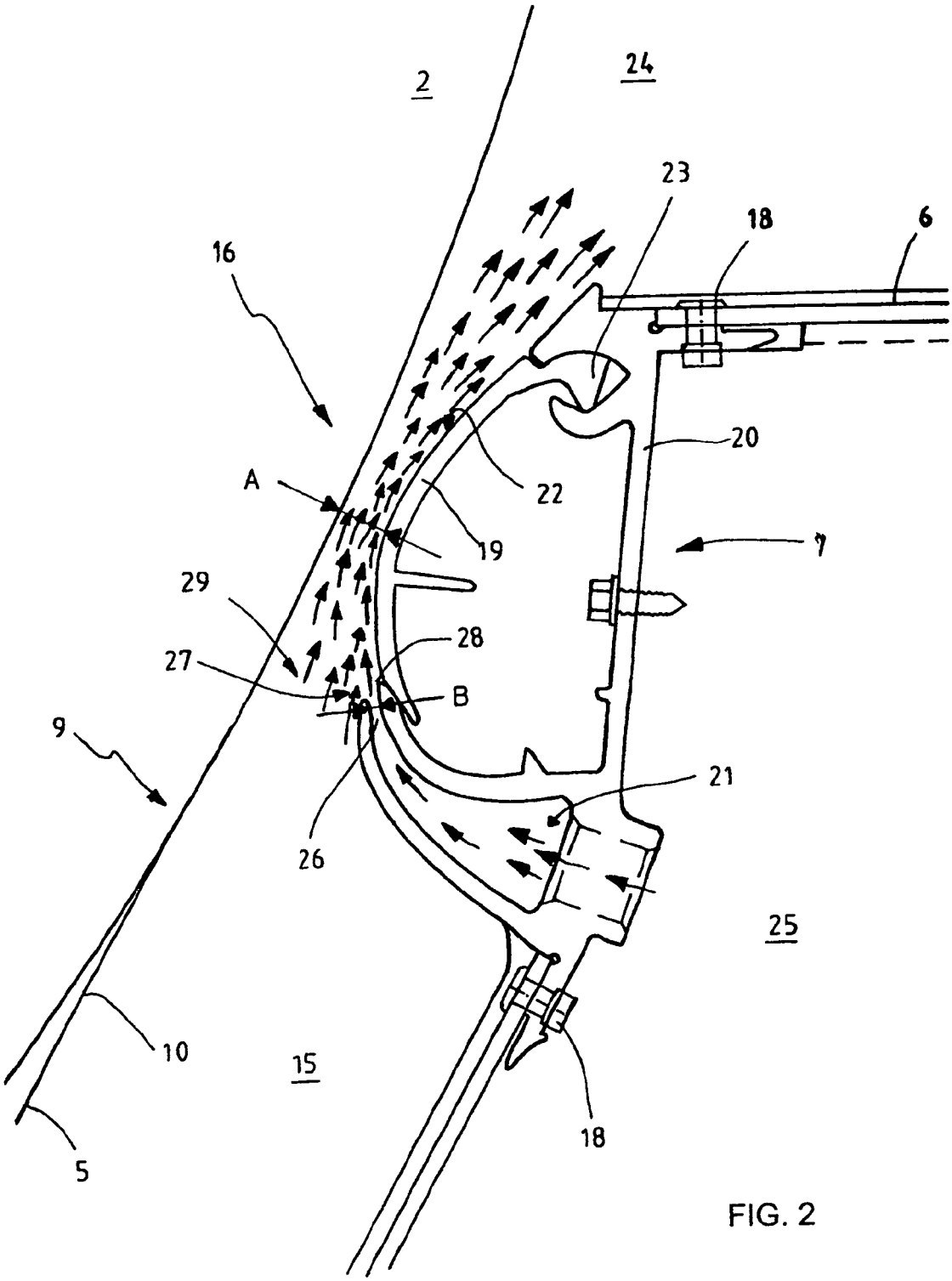
FIG. 2 presents a sealing point according to the invention in a first situation.

FIG. 2 presents the sealing point 16 according to the invention and the structures surrounding it. The wire 5 and the paper web (not shown) to be dried with it travel in the Figure along the surface of the drying cylinder 2 from above downwards. At the location of the opening nip 9 the wire begins the so-called free draw 10 towards the turning cylinder 4 (FIG. 1). A sealing element 7 is fastened with rivets 18 to the runnability component 6 so as to be immobile, which sealing element consists of a frame 20, a blow nozzle 21 and a sealing surface 19. The sealing surface 19 is turnably fastened to the frame 20 by means of a hinge 23. The surface of the sealing surface 19 facing the wire 5 is formed as a curved so-called Coanda surface 22. The operating principle of a Coanda surface is known as such and it is not described in this text in further detail. The wire 5 and the Coanda surface 22 are, at the closest, at a sealing distance A from each other. This location is called the sealing point 16. The sealing point 16 delimits the pocket space 15 to be brought into underpressure and the outer space 24 from each other. A room pressure of the paper mill typically prevails in the outer space 24. An underpressure of e.g. 100-300 Pa compared to the air pressure prevailing in the outer space 24 is aimed at in the pocket space 15.

Figure 3:
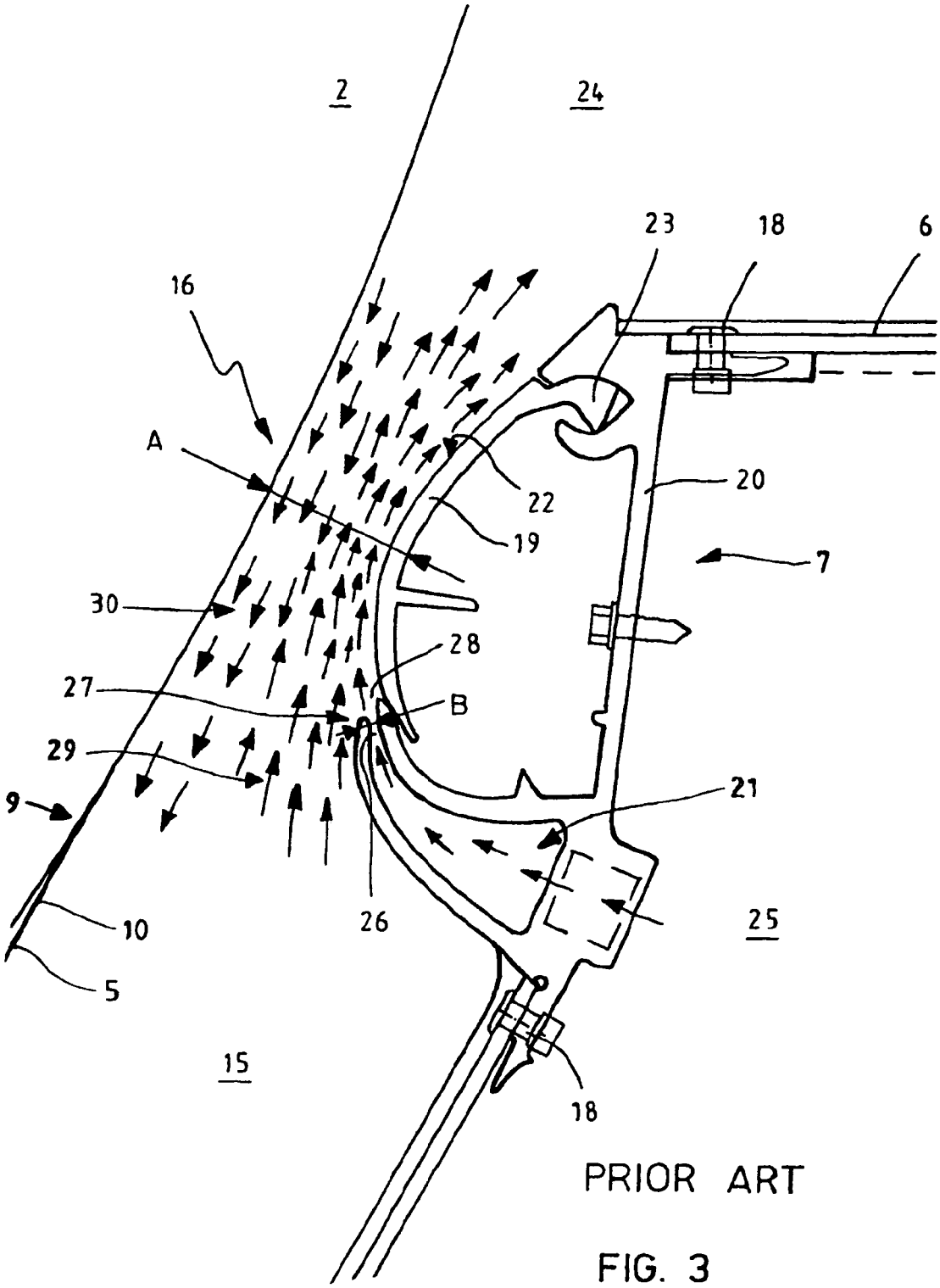
PRIOR ART FIG. 3
FIG. 3 presents the sealing point in a second situation.

The movements of the air flows are presented schematically by arrows in FIGS. 2 and 3. From the inside of the runnability component 6, pressurized air is lead from an air channel 25 to the blow nozzle 21, and further out of the nozzle via a nozzle slot 26 located in the nozzle head. The nozzle slot 26 is elongated in the cross direction of the paper machine, e.g. mainly of the width of the entire paper machine. At its narrowest dimension, the nozzle slot 26 is of the size of the nozzle diameter or width B. The location where the air to be blown exits from the nozzle slot 26 is called a blow point 27.

In the situation of FIG. 2 the sealing distance A and the nozzle slot B are chosen according to the invention such that the air layer 28 to be blown from the nozzle slot 26 along the Coanda surface 22 of the sealing surface, and the air 29 ejected along with it from the pocket space 15 just adequately fill, at the sealing point 16, the space between the wire 5 and the Coanda surface 22. Substantially all the air attains the outer space 24, and no back flow towards the pocket space 15 is created at the sealing point 16. The ratio A/B in the example of FIG. 2 is approximately 4. In the example of FIG. 2, the distance between the blow point 27 and the sealing point 16 as measured along the Coanda surface 22 of the sealing surface is approximately 3.5 times the sealing distance A.

The second sealing element 8 shown in FIG. 1 and placed in the second sealing point 17 is, by its structure, a reversed image compared to the first sealing element 7 shown in FIG. 2. This is why it is not described in further detail. The main difference in the situations of the sealing points 16 and 17 is that in the first sealing point 16 the air blow is performed against the travelling direction of the wire 5, whereas in the second sealing point 17 the air blow is mainly performed in a direction equal to the travelling direction of the wire 5.

In the example of FIG. 3 the ratio A/B is approximately 10 according to the prior art. The figure shows how a leakage flow 30 decreasing underpressure in the pocket space 15 travels into the pocket space 15 by the side of the wire 5.

Figure 4:
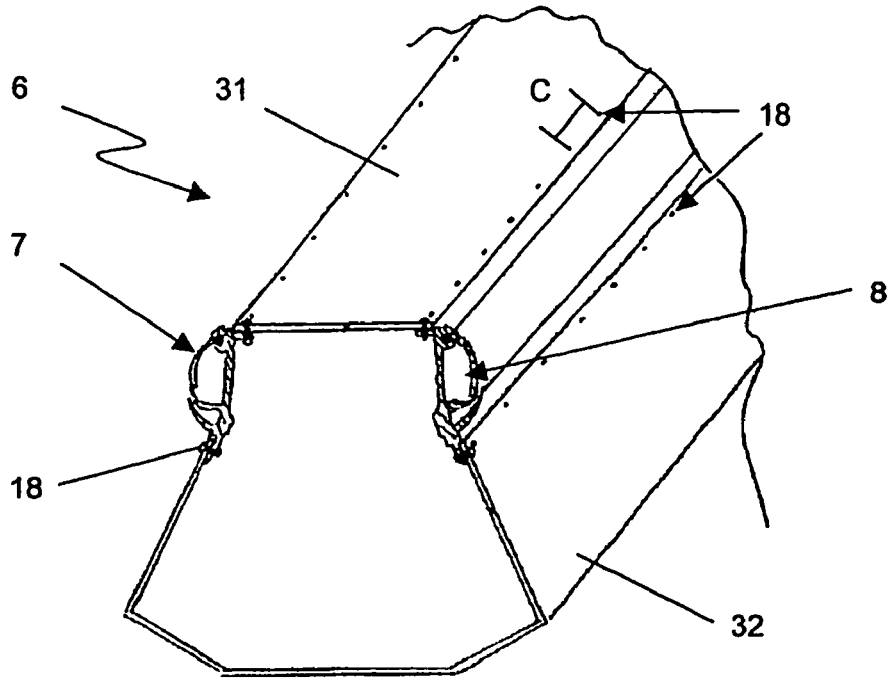
FIG. 4 presents, as a perspective view, a runnability component according to the invention.

FIG. 4 shows a runnability component 6 according to an embodiment of the invention. It consists of an upper frame plate 31, a lower frame plate 32 and two sealing elements 7 and 8. In the runnability component of the Figure, four joints having the length of the entire cross direction of the paper machine are required between the frame plates and the sealing elements. In the example of the Figure, the frame plates and the sealing elements are fastened to each other at every joint by rivets 18. The distance C between two rivets in the cross direction of the machine is approximately 20 cm.

The runnability component 6 is typically manufactured such that, at first, the frame plates 31 and 32 are manufactured and the sealing elements 7 and 8 are compiled. Typically thereafter the sealing elements 7 and 8 are riveted to the upper frame plate 31. The lower frame plate 32 is then fastened. For example, so-called structural rivets can be used as rivets. The riveted joint can be strengthened e.g. with industrial structural tape (not shown).

Figure 5:
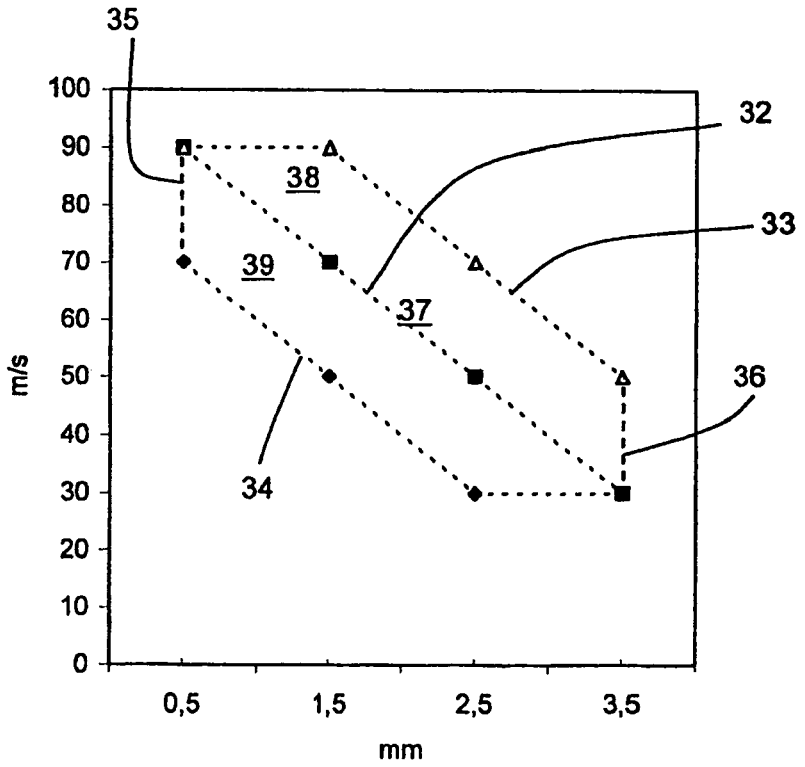
FIG. 5 presents some blow velocities used in a runnability component according to the invention as a function of the thickness of the air layer to be blown.

In FIG. 5 some advantageous blow velocities to be used in a runnability component 6 according to the invention are shown as a function of the thickness of the air layer 28 to be blown, i.e. as a function of the nozzle diameter or width B. The points of FIG. 5 are collected from the Table 1 comprising advantageous combinations. The lines marked with reference numbers 32, 33 and 34 have been obtained by combining the points of columns 32, 33 and 34 of the Table 1. In addition, the points on the left and the right side of the diagram are combined with broken lines 35 and 36. Thereby a space 37 defined by lines 33, 34, 35 and 36 is obtained, the combinations of blow velocities and thickness of the air layer 28 to be blown located in this area being advantageous. It has thus now been surprisingly found that when the velocity of the air layer 28 to be blown is chosen to a certain value depending on the size of the nozzle slot 26 to be used, a particular efficiency is obtained.

TABLE 1

| Thickness of | Blow velocity (m/s) | | |
|---|---|---|---|
| air layer (mm) | 34 | 32 | 33 |
| 0.5 | 70 | 90 | 90 |
| 1.5 | 50 | 70 | 90 |
| 2.5 | 30 | 50 | 70 |
| 3.5 | 30 | 30 | 50 |

Especially combinations located in the area 37 are advantageous, which combinations deviate from the line 32 at most 10 m/s upwards or downwards. An advantageous area according to the invention is the area 38 defined by the lines 32, 33 and 36. An advantageous area according to the invention is the area 39 defined by the lines 32, 34 and 35.

Only advantageous exemplary embodiments of the invention are described in the Figures. It is clear to a person skilled in the art that the invention is not restricted only to the examples presented above, but the invention may vary within the limits of the claims presented hereafter. For the sake of clarity, e.g. actuators for moving of the movable sealing surface 19 to different distances from the wire 5 known as such in the prior art are not shown in the Figures. Some possible embodiments of the invention are described in the dependent claims, and they are not to be considered to restrict the scope of protection of the invention as such.

What is claimed is:

1. An apparatus for sealing of a pocket space between drying cylinders in a paper machine or a board machine, comprising:

a first cylinder and a second cylinder;

a wire supported by the first and second cylinders and movable in relation to the first and second cylinders in a travelling direction of the wire;

a first runnability component elongated in a cross direction of the paper machine, the first and second cylinders, the wire and the first runnability component defining the pocket space, the first runnability component comprising:

a first sealing surface which is elongated in the cross direction and arranged a sealing distance A from the wire at a first sealing point, the sealing distance A being in the range 5-15 mm, the first sealing surface being fastened to the runnability component by a hinge such that the sealing distance A at the sealing point is changeable, and a first blow nozzle defining a nozzle slot having a nozzle width B in the range 0.5-3.5 mm and a length elongated in the cross direction, the nozzle slot being arranged to blow air from a first blow point towards the first sealing point and along the first sealing surface, the distance between the first blow point and the first sealing point measured along the first sealing surface is 2-5 times the sealing distance A.

2. The apparatus of claim 1, wherein the sealing distance A is in the range 8-10 mm, and the nozzle width B is in the range 1.5-2.5 mm.

3. The apparatus of claim 1, further comprising a second runnability component elongated in the cross direction of the paper machine, the second runnability component comprising:

a second sealing surface elongated in the cross direction, the second sealing surface being arranged, at a second sealing point, a sealing distance A from the wire; and a second blow nozzle defining a nozzle slot having a nozzle width B and a length elongated in the cross direction, the nozzle slot of the second blow nozzle being arranged to blow air towards the second sealing point at the second blow point and along the second sealing surface.

4. The apparatus of claim 1, further comprising a wire turning element supporting the wire between the first and the second cylinder in the travelling direction of the wire, the turning element defining a portion of the pocket space.

5. The apparatus of claim 1, wherein the nozzle slot and the blow point are disposed in the pocket space.

6. The apparatus of claim 1, wherein the sealing surface is a Coanda surface curved in the travelling direction of the wire.

7. The apparatus of claim 3, wherein the first blow nozzle is arranged so that the first blow nozzle blows air mainly against the travelling direction of the wire.

8. The apparatus of claim 7, wherein the second blow nozzle is arranged so that the second blow nozzle blows air mainly in the travelling direction of the wire.

9. A method for sealing of a pocket space between drying cylinders in a paper machine or board machine, the method comprising the steps of:

moving a wire in a travelling direction supported by a first cylinder and a second cylinder;

sealing, by a first runnability component, a gap between a pocket space and a space outside of the pocket space, the pocket space defined by the first and second cylinders, the wire and the first runnability component, the first runnability component being elongated in a cross direction of the paper machine and includes at least a first sealing surface elongated in the cross direction, and a first blow nozzle having a nozzle slot with a nozzle width B and a length elongated in the cross direction;

maintaining a sealing distance A between the first sealing surface and the moving wire in the range 5-15 mm at a first sealing point;

blowing, by the first blow nozzle, air from a first blow point and along the first sealing surface towards the first sealing point and further via the sealing point away from the pocket space, the nozzle width B being in the range 0.5-3.5 mm such that a thickness of an air layer discharged from the blow nozzle is in the range 0.5-3.5 mm, wherein the thickness of the air layer and a blow velocity of the air layer discharged from the blow nozzle at the blow point towards the first sealing point are chosen to be one of the following combinations:

the thickness of the air layer is in the range 0.5-1.5 mm and the blow velocity is in the range 70-90 m/s, the thickness of the air layer is in the range 1.5-2.5 mm and the blow velocity is in the range 50-70 m/s, or the thickness of the air layer is in the range 2.5-3.5 mm and the blow velocity is in the range 30-50 m/s.

10. The method of claim 9, wherein the sealing distance A is in the range 8-10 mm, and the nozzle width B is in the range 1.5-2.5 mm, whereby the thickness of the air layer discharged from the blow nozzle is in the range 1.5-2.5 mm.

11. The method of claim 9, wherein the air layer discharged from the blow nozzle at the blow point towards the first sealing point is blown at a blow velocity in the range 30 m/s-90 m/s.

* * * * *